United States Patent [19]

Bonazoli et al.

[11] 4,140,939

[45] Feb. 20, 1979

[54] TUNGSTEN HALOGEN LAMP FOR HEADLIGHTS

[75] Inventors: Robert P. Bonazoli, Hamilton; Stephen F. Kimball, III, Andover; Lewis H. Palmer, III, Marblehead, all of Mass.

[73] Assignee: GTE Sylvania Incorporated, Danvers, Mass.

[21] Appl. No.: 900,048

[22] Filed: Apr. 26, 1978

[51] Int. Cl.[2] ..... H01K 1/14; H01K 1/18; H01K 1/50

[52] U.S. Cl. ..... 313/222; 313/115; 313/272; 313/316

[58] Field of Search ..... 313/316, 222, 272, 113, 313/115

[56] References Cited

U.S. PATENT DOCUMENTS

| | | | |
|---|---|---|---|
| 2,315,504 | 4/1943 | Curtis | 313/272 |
| 2,791,714 | 5/1957 | Beesley | 313/115 |
| 2,821,649 | 1/1958 | Geiger | 313/316 |
| 3,898,451 | 8/1975 | Murphy et al. | 313/113 X |

*Primary Examiner*—Palmer C. Demeo
*Attorney, Agent, or Firm*—James Theodosopoulos

[57] ABSTRACT

A tungsten-halogen lamp for use in motor vehicle headlights comprises a tubular sealed glass capsule containing two coiled tungsten filaments, parallel to each other and disposed substantially orthogonally to the axis of the capsule. The two filaments are offset laterally from each other and one of the filaments is a coiled coil, in order to reduce the lateral traverse of both filaments.

3 Claims, 3 Drawing Figures

TUNGSTEN HALOGEN LAMP FOR HEADLIGHTS

THE INVENTION

This invention is concerned with motor vehicle headlights containing tungsten-halogen capsules and especially with such capsules containing two filaments for high beam-low beam operation. In the prior art, as shown in U.S. Pat. Nos. 3,736,454, 3,801,178, 3,904,,904 and 4,011,642 and as shown in U.S. Pat. No. 3,548,244 and British Pat. No. 1,158,887, both filaments were made of tungsten wire that was helically coiled once. In the first four patents the capsule used a reflecting screen for the low beam filament; therefore the filaments were offset longitudinally from each other. In the latter two patents, however, no reflector is used and, for proper operation, the filaments have to be offset laterally from each other. We have found that if one of the filaments comprises a coiled coil, the lateral offset can be reduced, which permits the diameter of the capsule to be reduced.

DESCRIPTION OF THE PREFERRED EMBODIMENT

Figure 1:
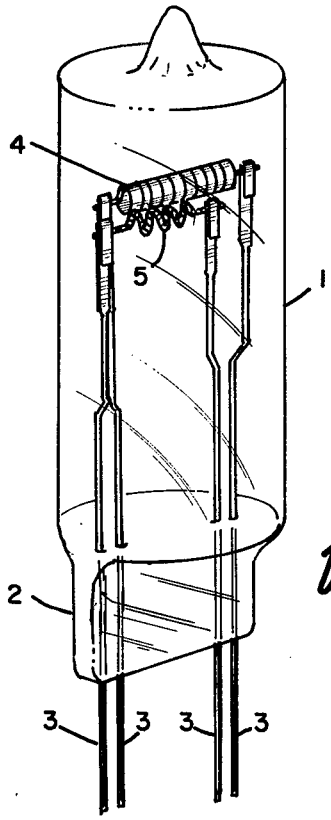
FIG. 1 is a perspective view of a tungsten-halogen capsule in accordance with this invention.
Figure 2:
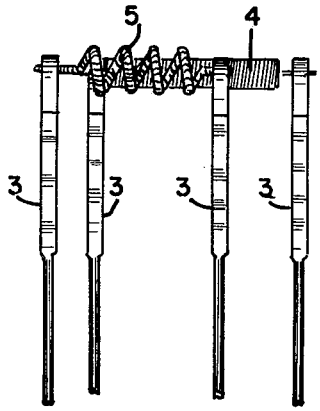
FIGS. 2 and 3 are side and front views, respectively, of the two tungsten filaments in the capsule.
Figure 3:
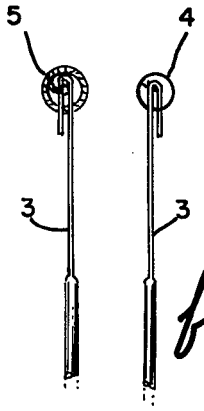

Glass capsule 1 has a seal 2 at one end with lead-in wires 3 extending through seal 2, and contains a gaseous filling including halogen. Supported on the internal ends of lead-in wires 3 are two spaced apart tungsten filaments 4 and 5. Filament 4 is a coiled filament and filament 5 is a coiled coil filament. Filaments 4 and 5 are in the same plane, substantially orthogonal to the axis of capsule 1, and are laterally offset, as shown in FIG. 2, in order to provide proper orientation of the beams radiated by the lamp assembly.

In one example, once coiled filament 4 was made of 50 mg/200 mm tungsten wire coiled on a 27 mil mandrel, had a coil diameter of 37 mils and a body length of 5½ mm.

Coiled coil filament 5 was also made of 50 mg/200 mm tungsten wire which was primary coiled on an 8 mil mandrel and was secondary coiled on a 22 mil mandrel; it had a diameter of 58 mils and a body length of about 3 mm.

Filaments 4 and 5 were parallel to each other, spaced about 1 mm apart and were laterally offset from each other. That is to say, at one end the body of filament 5 extended about 1 mm beyond the body of filament 4 and at the other end the body of filament 4 extended about 3½ mm beyond the body of filament 5. The diameter (OD) of capsule 1 was 17/32" and its length, excluding seal 2, was ¾".

In operation, capsule 1 is mounted in a curved reflector of the type shown in copending application Ser. No. 883,863, filed Mar. 6, 1978, same assignee, the disclosure of which is incorporated herein by reference, so that filaments 4 and 5 are substantially orthogonal to the axis of the reflector. Filaments 4 and 5 are mounted at or near the focus of the reflector. In said example, coiled coil filament 5 is the high beam filament and is mounted as the lower of the two filaments. 9n

We claim:

1. A tungsten-halogen capsule for use in a motor vehicle headlight comprising: a tubular sealed glass capsule; two tungsten filaments disposed in the capsule, the filaments being spaced apart and parallel to each other and substantially orthogonal to the axis of the capsule, one of the filaments being a once coiled filament and the other being a coiled coil filament, the filaments being laterally offset from each other.

2. The capsule of claim 1 wherein the filaments are supported on lead-in wires embedded in the seal of the capsule.

3. The capsule of claim 1 wherein the coiled coil filament is shorter than the once coiled filament.

* * * * *

Notice of Adverse Decision in Interference

In Interference No. 100,401, involving Patent No. 4,140,939, R. P. Bonazoli, S. F. Kimball, III, and L. H. Palmer, III, TUNGSTEN HALOGEN LAMP FOR HEADLIGHTS, final judgment adverse to the patentees was rendered June 21, 1983, as to claims 1, 2 and 3.

[*Official Gazette February 7, 1984.*]